US006089213A

United States Patent [19]

Laudien et al.

[11] Patent Number: 6,089,213

[45] Date of Patent: Jul. 18, 2000

[54] LUBRICATING OIL FILL LINE FOR AN INTERNAL COMBUSTION ENGINE, INVOLVING A OIL MIST SEDIMENT TANK

[75] Inventors: Mike Laudien, Gerlingen; Rolf Möhle, Bretzfeld, both of Germany

[73] Assignee: Knecht Filterwerke GmbH, Stuttgart, Germany

[21] Appl. No.: 09/355,298

[22] PCT Filed: Jan. 3, 1998

[86] PCT No.: PCT/DE98/00050

§ 371 Date: Jul. 28, 1999

§ 102(e) Date: Jul. 28, 1999

[87] PCT Pub. No.: WO98/35141

PCT Pub. Date: Aug. 13, 1998

[30] Foreign Application Priority Data

Feb. 7, 1997 [DE] Germany ..... 197 04 594

[51] Int. Cl.[7] ..... F01M 13/04

[52] U.S. Cl. ..... 123/572

[58] Field of Search ..... 123/572, 574, 123/573, 41.86

[56] References Cited

U.S. PATENT DOCUMENTS 4,169,432 10/1979 White ..... 123/574

4,401,093 8/1983 Gates, Jr. et al. ..... 123/572

4,768,493 9/1988 Ohtaka et al. ..... 123/574

*Primary Examiner*—Marguerite McMahon

*Attorney, Agent, or Firm*—Collard & Roe, P.C.

[57] ABSTRACT

On a lubricating oil fill line for an internal combustion engine, provided with an oil mist sediment tank installed in the fill area and designed to ensure the crank case ventilation, the oil flowing out of the oil mist sediment tank is recycled by the gravity force back to the crank case as return oil. This system has the following features: for the return oil is provided a return line from the oil mist sediment tank; the distal end of this return line relative to the sediment tank leads to the bottom area of a transfer tank especially designed to receive and recycle the return oil; a gas pressure is exerted at the overflow outlet of the overflow tank which corresponds to that to which the oil mist is submitted when back to the sediment tank. Such a facility permits to save space during the manufacture process. Furthermore, ensuring a differential pressure between the air to be purified inside the crank case at the oil mist sediment tank inlet, on the one hand, and the precipitated oil at the oil mist sediment tank outlet, obtains good oil sedimentation.

6 Claims, 1 Drawing Sheet

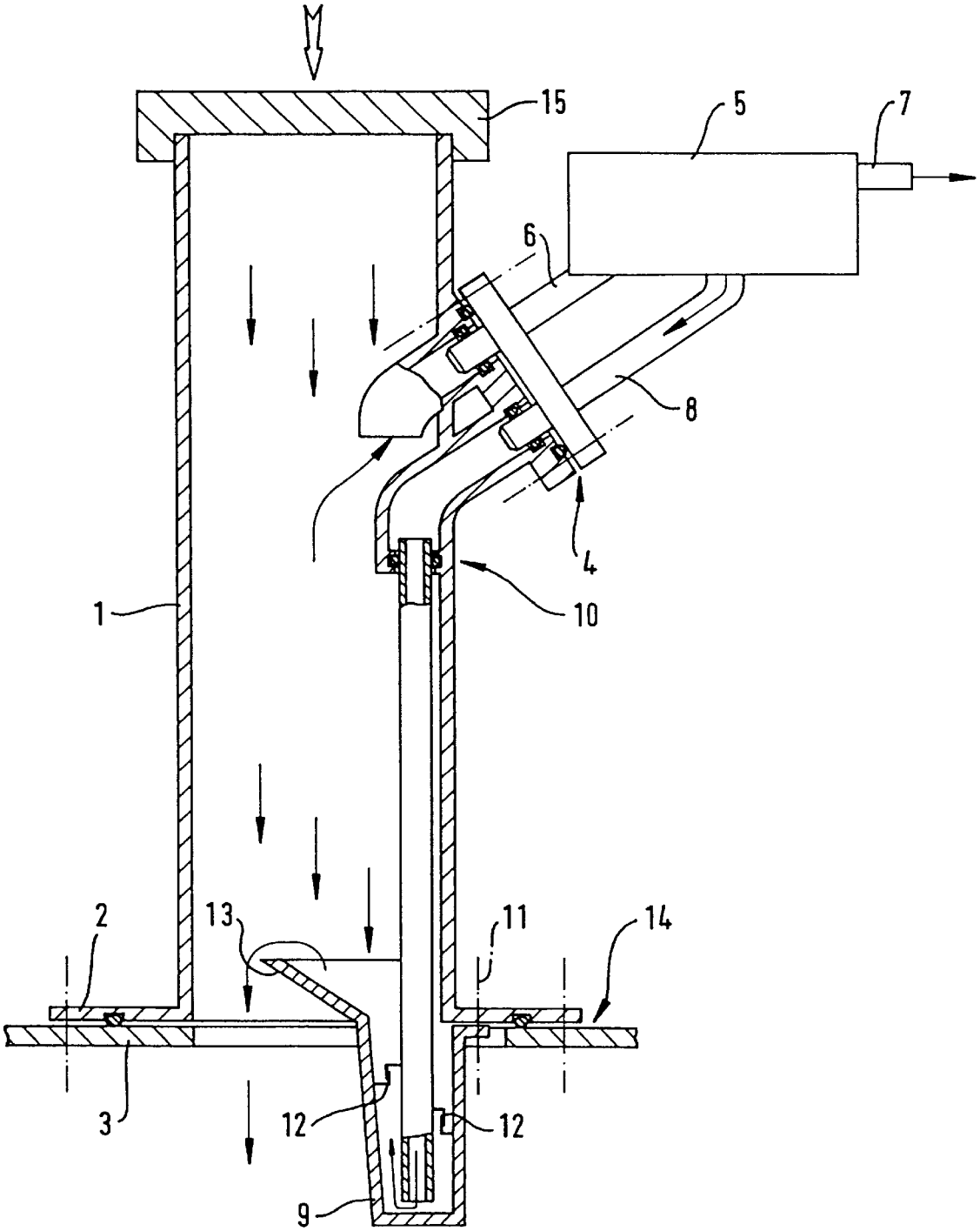
15
5
7
6
8
4
10
1
2
13
11
14
3
12
12
9

LUBRICATING OIL FILL LINE FOR AN INTERNAL COMBUSTION ENGINE, INVOLVING A OIL MIST SEDIMENT TANK

The invention relates to a lubricating oil filler line of an internal combustion engine with an oil mist separator mounted in the filling region of said line and intended for crankcase ventilation, according to the preamble of patent claim 13.

Such a device is known from U.S. Pat. No. 2,354,722.

Proceeding from this, the invention is concerned with the problem of designing such a generic device for cost-effective production from plastic, whilst at the same time optimizing the functional properties of this device.

The solution according to the invention consists of a generic lubricating oil filler line having the defining features of patent claim 13.

In this device, the return oil can flow into a space, in which a lower gas pressure prevails than in the crankcase region, out of which the oil mist to be freed of oil is extracted when crankcase ventilation is taking place. The device according to the invention may be given a compact design, using an overflow vessel, to be provided at any desired point, at the outflow end of the oil return line. The lubricating oil filler line may be designed, together with the return-oil line, a crankcase breather line and the overflow vessel, as a so-called modular part which can be handled as a unit and which can be flanged to an internal combustion engine. In this case, the oil mist separator is part of the module formed by the lubricating oil filler line, this oil mist separator being connected to said lubricating oil filler line so as to be capable of being separated in a simple way.

The fact that the oil returning from the oil mist separator can flow back counter to a gas pressure lower than in the crankcase to be ventilated arises as follows.

Since the return-oil line terminates in the vicinity of the bottom of an overflow vessel filled with lubricating oil during operation, there is a liquid barrier between the oil mist separator space, in which the return oil accumulates, and the space out of which oil mist to be freed of oil is extracted from the crankcase of the internal combustion engine. A pressure gradient generated in this way on the oil mist separator between the inlet space for the oil mist and the outlet space for separated oil is advantageous for the functioning of an oil mist separator. This applies, in particular, to the use of a cyclone as the oil mist separator.

It is necessary, for satisfactory functioning of the device, that the bottom of the overflow vessel be located vertically below the oil mist separator over a sufficient length when the lubricating oil filler orifice is in the operating position. Moreover, the overflow vessel must be capable of receiving a sufficiently large volume. The two conditions mentioned above are explained as follows.

A specific vertical distance between the oil mist separator and the bottom of the compensating vessel is necessary, so that a liquid head counteracting the overpressure in the adjacent gas space can form in the return-oil line, without penetrating into the oil mist separator to an extent such that the functioning of the latter is impaired. The overflow vessel must have a sufficient filling volume, so that sufficient liquid is available for rising in the return-oil line so as to compensate the gas pressure. In practice, the abovementioned vertical distance between the oil mist separator and the bottom of the overflow vessel, on the one hand, and the filling volume of this vessel, on the other hand, are designed in such a way that, in all operating states, on the one hand, it is still just not possible for any return oil to flow back into the oil mist separator, or build up there, so as to impede the functioning of the latter, and, on the other hand, in each case, sufficient liquid is available in the overflow vessel for a maximum rising height of the oil in the return line.

The overflow vessel is advantageously arranged with its orifice inside the lubricating oil filler line, in such a way that lubricating oil, which is introduced into the lubricating oil filler line, must necessarily fill the overflow vessel. Such a design ensures that the liquid barrier which is sought according to the invention is guaranteed as soon as an engine is started up.

A compact design in terms of the connection of the oil mist separator to the lubricating oil filler line is obtained when the oil mist is extracted through the lubricating oil filler line by means of a connecting line provided for this purpose between the oil mist separator and the lubricating oil filler line. The connection of the last-mentioned line to the lubricating oil filler line is expediently located in the immediate vicinity of the return-oil line. In the region of connection of the two abovementioned lines, the oil mist separator is fastened to the lubricating oil filler line via a flanged connection with having, in particular, plug closures for the lines of said oil mist separator.

The return-oil line is located in the interior of the lubricating oil filler line. This line can be designed to be capable of being separated there via a plug connection.

The overflow vessel is advantageously firmly connectable to the lower end of the return-oil line which, in particular, can be connectable to an upper part via the abovementioned plug connection.

By a fastening means provided in the region of the overflow vessel on the return-oil line, the latter can be capable of being fastened releasably to the lubricating oil filler line.

By means of the above-described releasable separating connections between the individual parts, the complete part to be designed as a module can be produced in a simple way as a plastic part which can be mounted on the internal combustion engine via a flanged connection.

An exemplary embodiment, the description of which will also refer to other advantages, is illustrated in the drawing.

This shows a diagrammatic illustration, in longitudinal section, of a lubricating oil filler line with an attached oil mist separator and with a return-oil line leading into an overflow vessel.

A lubricating oil filler line 1 is capable of being fastened to a region of an internal combustion engine 3 via a flange 2, said region being connected to the crankcase of the internal combustion engine 3. The interior of the lubrication oil filler line 1 is connected to the crankcase through the flanged connection 14 by means of an orifice in this region of an outer wall of the engine. Lubricating oil can be introduced at the upper orifice of the lubricating oil filler line 1, said orifice being capable of being closed by means of a cover 15.

An oil mist separator 5 is releasably connected to the lubricating oil filler line 1 in the upper region of the latter via a flanged connection 4. The oil mist separator is, in particular, a cyclone separator.

The oil mist to be freed of oil passes into the oil mist separator 5 via a crankcase breather line 6 capable of being interrupted in the flanged connection 4. The vented air freed of oil leaves the oil mist separator 5 via a connection piece 7.

The oil separated in the oil mist separator 5 is led into the interior of the lubricating oil filler line 1 via a return-oil line 8 capable of being separated in the flanged connection 4.

The separability of the lines 6 and 8 of the flanged connection 4 is ensured via plug connections.

Within the lubricating oil filler line 1, the return-oil line 8 extends vertically downward as far as the bottom of an overflow vessel 9. In this case, a part of the return-oil line 8 which starts from the bottom of the overflow vessel 9 is designed as a part capable of being separated from the upper part of this line via a plug connection 10.

The overflow vessel 9 is fastened to that part of the internal combustion engine 3 to which the lubricating oil filler line is likewise fastened. This fastening is releasable and is indicated diagrammatically in the drawing in the region 11.

A releasable connection between the overflow vessel 9 and the lower separable part of the return-oil line 8 is indicated diagrammatically in regions 12.

The orifice of the overflow vessel 9 is widened in a funnel-shaped manner, at least in a part circumferential region 13, in order thereby to ensure that the overflow vessel 9 is necessarily filled up when the lubricating oil filler line 1 is being filled.

The vertical distance between the oil mist separator 5 and the bottom of the overflow vessel 9 must be designed in such a way that, by virtue of the pressure difference prevailing between the interior of the lubricating oil filler line 1 and the return-oil outflow space of the oil mist separator 5, oil rising to compensate pressure in the return-oil line 8 cannot penetrate into the oil mist separator, even under operating conditions which, in this respect, are most unfavorable. For this purpose, of course, the filling volume of the overflow vessel 9 must also be designed to be correspondingly large. These dimensional ratios are not given true to scale in the diagrammatic illustration of the exemplary embodiment.

The modular component according to the invention, consisting of the lubricating oil filler line 1, the oil separator 5, the crankcase breather line 6 and the return-oil line 8 with an associated overflow vessel 9, may also be provided with an oil dipstick not illustrated.

What is claimed is:

1. A lubricating oil filler line of an internal combustion engine (1) with an oil mist separator (5) for crankcase ventilation, out of which the oil separated from the oil mist separator (5) flows as return oil under the effect of gravity, and in which a return-oil line (8) starting from the oil mist separator (5) and leading into the interior of the lubricating oil filler line (1) is provided for the return oil, that end of the return-oil line (8) which is remote from the oil mist separator (5) leads into the bottom region of an overflow vessel (9) intended for receiving and transferring the return oil, a gas pressure prevails at the overflow orifice of the overflow vessel (9), said gas pressure corresponding to that under which the oil mist arriving at the oil separator (5) is, the lubricating oil filler line (1) is designed as an independent element which has, at one end, a flange (2) for a connection to an internal combustion engine and, at its other end, a closeable filler orifice, defined by the features the oil mist separator (5) is located outside the lubricating oil filler line (1) and is connected to the latter via a separating flange of a flanged connection (4), for crankcase ventilation, a line (6) leads out of the interior of the lubricating oil filler line (1) into the oil mist separator (5), the lines (6) and (8) run through the flanged connection (4) and are separate.

2. The lubricating oil filler line as claimed in claim 1, wherein the separability of the lines (6, 8) is ensured by plug-connection means provided on these lines within the flanged connection (4).

3. The lubricating oil filler line as claimed in claim 1, wherein the overflow vessel (9) is connected in a nondestructively separable manner via fastening means (12) to that end of the return-oil line (8) which leads into said overflow vessel.

4. The lubricating oil filler line as claimed in claim 1, wherein the return-oil line (8) can be separated within the lubricated oil filler line (1), in an end facing away from that end of the return-oil line (8) which projects into the overflow vessel (9), by the release of a plug connection (10).

5. The lubricating oil filler line as claimed in claim 1, wherein the overflow orifice of the overflow vessel (9) is arranged within the lubricating oil filler line (1), this arrangement being such that lubricating oil, when being introduced into the lubricating oil filler line (1), passes into the overflow vessel (9).

6. The lubricating oil filler line as claimed in claim 1, wherein the oil mist separator (5) is a cyclone separator.

* * * * *